US005877616A

United States Patent [19]

Wan et al.

[11] Patent Number: 5,877,616

[45] Date of Patent: Mar. 2, 1999

[54] LOW VOLTAGE SUPPLY CIRCUIT FOR INTEGRATED CIRCUIT

[75] Inventors: Ray-Lin Wan, Fremont, Calif.; Chun-Hsiung Hung, Hsinchu, Taiwan

[73] Assignee: Macronix International Co., Ltd., Hsinchu, Taiwan

[21] Appl. No.: 849,676

[22] PCT Filed: Sep. 11, 1996

[86] PCT No.: PCT/US96/14712

§ 371 Date: Jun. 13, 1997

§ 102(e) Date: Jun. 13, 1997

[87] PCT Pub. No.: WO98/11660

PCT Pub. Date: Mar. 19, 1998

[51] Int. Cl.[6] ..... G05F 3/16

[52] U.S. Cl. ..... 323/315; 323/317

[58] Field of Search ..... 323/313, 315, 323/316, 317; 327/581, 576, 436, 437

[56] References Cited

U.S. PATENT DOCUMENTS

| | | | |
|---|---|---|---|
| 4,300,091 | 11/1981 | Schade, Jr. | 323/315 |
| 4,453,094 | 6/1984 | Peil et al. | 323/315 |
| 5,204,612 | 4/1993 | Lingstaedt | 323/317 |
| 5,315,230 | 5/1994 | Cordoba et al. | 323/313 |
| 5,446,397 | 8/1995 | Yotsuyanagi | 327/66 |
| 5,481,179 | 1/1996 | Keeth | 323/315 |
| 5,506,543 | 4/1996 | Yung | 330/253 |
| 5,512,855 | 4/1996 | Kimura | 327/538 |

*Primary Examiner*—Shawn Riley
*Attorney, Agent, or Firm*—Mark A. Haynes; Wilson, Sonsini, Goodrich & Rosati

[57] ABSTRACT

A low voltage supply circuit supplies an internal supply voltage in an integrated circuit, while consuming very little stand-by current, and providing substantial driving power to maintain the internal supply nodes at the desired voltage level. The low voltage supply circuit includes a first branch and a second branch. The first branch includes a pull-up circuit, a first transistor, a second transistor, and a reference circuit connected in series. The drain and the gate of the first transistor are connected to a first node. The pull-up circuit in the first branch is coupled between the first node and a power supply node. The drain and the gate of the second transistor are connected to a second node. The reference circuit is connected between the ground supply node of the integrated circuit and the second node, supplying a reference potential to the second node. The sources of the first and second transistors are coupled in common to a third node in the first branch. The second branch of the low voltage supply circuit includes a third transistor and a fourth transistor. The drain of the third transistor is coupled to a power supply node, the gate of the third transistor is connected to the first node in the first branch, and the source of the third transistor being connected to an output node for the low voltage supply circuit. The drain of the fourth transistor is coupled to the ground supply node, the gate of the fourth transistor is connected to the second node in the first branch, and the source of the fourth transistor is connected to the output node. Bias circuits induce a larger body effect in the fourth transistor than in the second transistor, so that the fourth transistor has a threshold voltage higher in absolute value than the second transistor. The bias circuits also induce a larger body effect in the third transistor than in the first transistor, so that the third transistor has a threshold voltage higher in absolute value than the first transistor.

29 Claims, 2 Drawing Sheets

LOW VOLTAGE SUPPLY CIRCUIT FOR INTEGRATED CIRCUIT

BACKGROUND OF THE INVENTION

1. Field of the Invention

The present invention relates to the generation of an internal supply voltage on integrated circuits; and more particularly to internal supply voltages having a lower potential than power supply potentials provided to the integrated circuit, and which consume very little stand-by power.

2. Description of Related Art

In the design of integrated circuits, a need often arises to provide a supply voltage on the integrated circuit which is lower than the voltage supplied by an external power supply. For example, in the design of flash memory devices, it is typical to provide an external supply voltage at about 5 volts, and at times, at about 12 volts. A number of other supply voltage levels are required for the complex procedures involved in a programming and erasing and reading the flash memory cells. The problems associated with various supply voltages in flash memory devices can be understood, for example, with reference to U.S. Pat. No. 5,295,113; entitled FLASH MEMORY SOURCE INHIBIT GENERATOR, invented by Dix, et al.

A circuit that supplies a supply voltage in an integrated circuit must be capable of sustaining substantial on demand current, in order to maintain the voltage potential at its output under varying load conditions. Prior art designs for generating internal supply voltages of this type, therefore have been relatively high power consumers. For example, in the Dix, et al. patent cited above, a low voltage supply circuit is described which is used for the so-called source inhibit function in a flash memory integrated circuit having the architecture described in Dix, et al. Although the supply circuits of Dix, et al. operate to provide a relatively stable internal supply voltage, they suffer the disadvantage that they consume substantial current even in the stand-by mode.

As the design of integrated circuits has evolved toward uses in which low current stand-by modes are important, a need has arisen to provide internal supply voltages with much less stand-by current consumption than has been available in the prior art.

SUMMARY OF THE INVENTION

The present invention provides a low voltage supply circuit that supplies an internal supply voltage in an integrated circuit, which consumes very little stand-by current, yet provides substantial driving power to maintain the internal supply node at the desired voltage level.

The low voltage supply circuit of the present invention can be characterized as having a first branch which is connected to a first power supply node on an integrated circuit, and includes a pull-up circuit, a first transistor, a second transistor, and a reference circuit connected in series. The first transistor has a drain, a source and a gate; the drain and the gate of the first transistor being connected to a first node. The pull-up circuit in the first branch is coupled between the first node and the first power supply node. The second transistor has a drain, a source and a gate; the drain and the gate of the second transistor being connected to a second node. The reference circuit is connected between the ground supply node of the integrated circuit and the second node, supplying a reference potential to the second node. The sources of the first and second transistors are coupled in common to a third node in the first branch. A second branch of the low voltage supply circuit includes a third transistor and a fourth transistor. The third transistor has a drain, a source and a gate, the drain of the third transistor being coupled to the second power supply node, the gate of the third transistor being connected to the first node in the first branch, and the source of the third transistor being connected to an output node for the low voltage supply circuit. The fourth transistor in the second branch has a drain, a source and a gate. The drain of the fourth transistor is coupled to the ground supply node, the gate of the fourth transistor is connected to the second node in the first branch; and the source of the fourth transistor is connected to the output node.

The transistors in the first and second branches of the low voltage supply circuit are biased by circuits that induce a larger body effect in the fourth transistor than in the second transistor, so that the fourth transistor has a threshold voltage higher in absolute value than the second transistor. The bias circuits also induce a larger body effect in the third transistor than in the first transistor, so that the third transistor has a threshold voltage higher in absolute value than the first transistor. As explained in detail below, the internal supply voltage is provided at the output node on the second branch.

The level of the low supply voltage at the output node is determined by the reference voltage generated by the reference circuit in the first branch of the low voltage supply circuit, plus the threshold voltage on the fourth transistor. Because of the bias circuits, when the output node of the circuit reaches the desired level, both the third and the fourth transistors in the second branch are off. Thus, the stand-by current consumed by this circuit is limited essentially to that in the first branch of the circuit, which can be very small. Only when the output voltage is pulled downward by a load on the circuit do the transistors in the output branch turn on, to supply the needed drive current. The stand-by current consumed according to one preferred embodiment of the present invention is in the range of 10 microamps, while the drive current capability of the circuit at the output node is several orders of magnitude higher, such as 5 milliamps or more.

In one embodiment, where the first and second power supply nodes receive a positive potential, and the internal supply voltage has a positive value, the first and third transistors are n-channel field effect transistors, and the second and fourth transistors are p-channel field effect transistors. The p-channel transistors are formed in n-type wells on the integrated circuit. The well of the second transistor is coupled to its source, to limit the body effect within the transistor. This establishes a threshold level for the second transistor which is near the intrinsic level for the device. The n-type well of the fourth transistor is coupled to the supply potential, such as 5 volts, or another voltage level which is higher than the voltage generated at the output node. This causes the threshold voltage of the fourth transistor to be increased by the body effect, to a level which is higher than the threshold voltage of the second transistor. Because the threshold voltage of the second transistor is less than the threshold voltage of the fourth transistor, the potential at the third node in the first branch of the circuit is less than the potential at the output node in the second branch of the circuit. This causes the source voltage on the first transistor to be lower than the source voltage on the third transistor. The lower source voltage causes a lesser body effect in the first transistor, than occurs on the third transistor. Thus the threshold of the first transistor is less than the threshold of the third transistor.

In operation, the first branch of the circuit operates to generate steady reference voltages at the first and second nodes, which are connected respectively to the gates of the third and fourth transistors. When the voltage on the output node of the circuit is higher than the sum of the reference potential at the second node and the threshold of the fourth transistor, then the fourth transistor turns on and pulls the voltage potential down. When the voltage reaches a value equal to the sum of the reference potential at the second node plus the threshold voltage of the fourth transistor, then the fourth transistor turns off. If the potential at the first node falls below the sum of the reference potential at the first node less the threshold of the third transistor (which is near the level equal to the sum of the reference potential at the second node, plus the threshold of the fourth transistor), then the third transistor turns on and pulls the voltage level at the output node up, until the output voltage reaches a value equal to the reference potential generated at the first node in the first branch of the circuit less the threshold of the third transistor. At this time, the third transistor turns off. Accordingly, the output branch of low voltage supply circuit of the present invention is normally off, and only generates current in response to loading on the output node. Stand-by current of the circuit is essentially limited to the first branch, which can be maintained at very low current levels.

Other aspects of the present invention include implementing the pull-up circuit with a resistive element connected between the first power supply node and the first node of the circuit. Such resistive element comprises a p-channel field effect transistor in one alternative, having a gate coupled to a reference potential such as ground where it acts as a resistive element. In similar fashion, the reference circuit which is connected between ground and the second node of the first branch, comprises a p-channel field effect transistor having its gate coupled to a reference potential such as ground. Alternatively, the reference circuit may comprise a low resistance connection between the second node and ground so that the reference potential at the second node of the circuit is substantially the ground potential.

According to yet other aspects of the invention, switches for enabling and disabling the circuit are included. Thus, a first switch is connected between the reference circuit and ground, and a second switch is connected between the fourth transistor and ground. The first and second switches enable the low voltage supply circuit when they are closed, and disable the low voltage supply circuit when they are open.

A third switch according to another aspect of the invention is coupled between the output node and the second supply potential. The third switch enables the low voltage supply circuit when it is open, and disables the low voltage supply circuit when it is closed. Also, when closed, the third switch pulls up the voltage at the output node to the supply potential, providing an initialization value, and preventing the floating of the node. In an alternative, a third switch is coupled between the third transistor and the second power supply node, which enables the circuit when it is closed, and disables the circuit when it is open. The switches are implemented using transistors having their gates connected to a control signal in a preferred embodiment.

The first and second supply nodes as discussed above, are coupled to the first and second branches of the circuit. The first branch of the circuit is used for generating constant reference voltages to control the operation of the second. Thus, it may be desirable to provide greater control over the voltage levels generated. Thus, in some circuits it may be desirable to use a high potential power supply connected to this first power supply node, which typically is specified to vary less than 5% its range, such as 12 volts +/−0.6 volts. This results in less than 5% variation in the reference potentials generated, and tighter control on the voltage level of the output node. In alternative systems, the standard power supply voltage is coupled to both the first and second power supply nodes on the integrated circuit. Thus, a 5 volt +/−10% power supply may be coupled to both branches of the circuit, resulting in lower power consumption, but less tight control over the output voltage node. In yet other alternatives, a more tightly regulated supply voltage can be utilized for the first branch of the circuit, such as supply voltages generated by voltage regulators, or otherwise tightly controlled.

Accordingly, the present invention provides a low voltage supply circuit for implementation on an integrated circuit, which consumes very little stand-by current yet provides substantial supply drive current for use in complex integrated circuits, such as flash memory devices.

DETAILED DESCRIPTION

Figure 1:
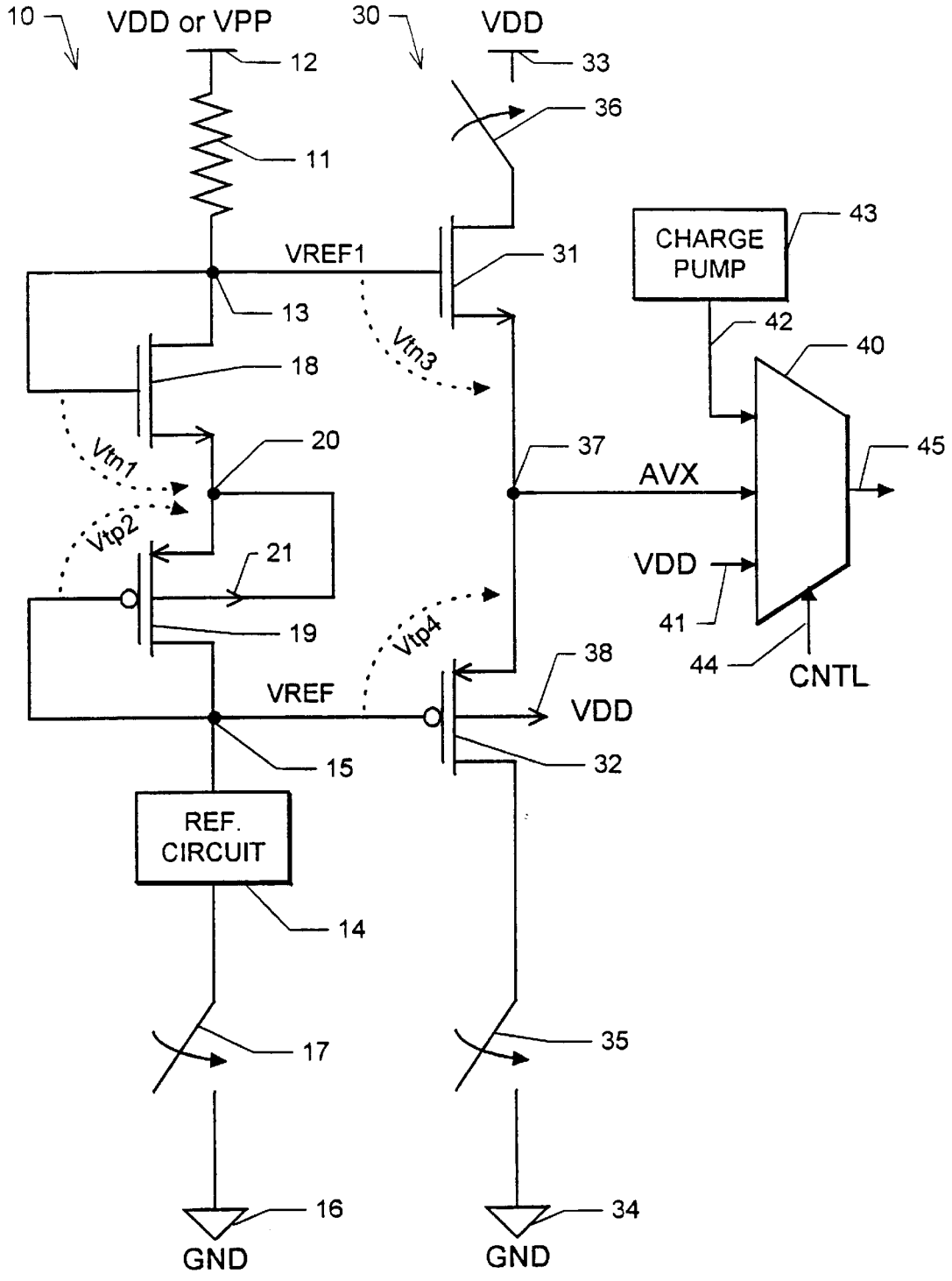
FIG. 1 is a simplified diagram of the low voltage supply circuit of the present invention.

A detailed description of preferred embodiments of the present invention is described with reference to FIGS. 1 and 2, in which FIG. 1 provides a simplified diagram of the circuit.

As can be seen in FIG. 1, the low voltage supply circuit of the present invention includes a first branch 10 and a second branch 30. The first branch 10 includes a pull-up element 11, such as a resistor which is connected between a supply node 12 and a first node 13 in the circuit.

A referenced circuit 14 is coupled between a second node 15 and ground terminal 16 in the first branch. A control switch 17 is connected between the reference circuit 14 and ground 16. A first transistor 18 and a second transistor 19 are connected between the first node 13 and the second node 15. The drain and gate of the first transistor 18 are connected to the first node 13. The drain and gate of the second transistor 19 are connected to the second node 15. The source of the first transistor 18 and the source of the second transistor 19 are coupled in common to a third node 20. The first transistor 18 is an n-channel field effect transistor. The second transistor 19 is a p-channel field effect transistor which is implemented in a n-type well in the integrated circuit substrate. The n-type well 21 of the second transistor 19 is coupled to the third node 20 of the circuit.

The second branch of the circuit includes a third transistor 31 and a fourth transistor 32 which are connected between a supply node 33 and ground 34. A control switch 35 is connected between the fourth transistor 32 and ground 34. Also, a control switch 36 is connected between the third transistor 31 and the supply potential 33.

The third transistor 31 is a n-channel field effect transistor which has its gate connected to the first node 13 in the first branch 10 of the circuit, its source coupled to an output node 37 for the low voltage supply circuit, and its drain coupled to the supply potential 33 (optionally through switch 36). The fourth transistor 32 is a p-channel field effect transistor implemented in a n-type well. The n-type well 38 is coupled to a supply potential such as about 5 volts, or another voltage which is higher than the potential at node 37. The drain of transistor 32 is coupled to the ground potential 34 (optionally through switch 35).

The low voltage supply circuit of FIG. 1 generates the low supply potential AVX at node 37. This supply potential is used for example in a flash memory device for the purpose of biasing wordline drivers on the device. Thus, the low supply potential on line 37 is connected to a multiplexer 40. Other inputs to the multiplexer include, for examples, the supply potential VDD on line 41, the output on line 42 of a charge pump circuit 43, or other voltage sources used for biasing the wordline driver. The control signal on line 44 controls the multiplexer 40 to supply one of the input supply potentials on line 45 to the wordline driver.

This application of the low voltage supply circuit of the present invention can be understood with reference to our co-pending international patent application entitled Decoded Wordline Driver With Positive and Negative Voltage Modes; PCT Application No: PCT/US95/01031; filed 26 January 1995; invented by Yiu, et al.

In operation, the first branch 10 of the low voltage supply circuit is a low current leg which produces a reference potential VREF at node 15, and a reference potential VREF1 at node 13. The reference potential VREF at node 15 is determined by the reference circuit 14. The reference circuit 14 may take a variety of implementations, including a resistive element, a transistor biased as a resistive element, or a low resistance connection, such as a short circuit, directly to ground. Thus the reference potential at node 15 can be specified by design parameters of the reference circuit 14 as suits the needs of the particular implementation.

The reference potential VREF1 at node 13 is equal to the sum of the reference potential VREF at node 15, the absolute value of the threshold voltage |Vtp2| of transistor 19, and the threshold voltage |Vtn1| of the first transistor 18.

The pull-up circuit 11 is a resistive element which serves to limit the current through the first branch 10 preferably, in the microamp range such as about 10 microamps.

The second branch 30 of the low voltage supply circuit operates to supply current to node 37 which maintains the potential at the AVX level. The AVX level is equal to the sum of the reference potential VREF at node 15 plus the threshold voltage |Vtp4| of the fourth transistor 32.

The low voltage supply circuit of FIG. 1 includes bias circuits which take advantage of the body effect to control the threshold voltages of the first transistor 18, the second transistor 19, the third transistor 31, and the fourth transistor 32. In particular, the n-well 21 of the second transistor is coupled to its source, substantially reducing the body effect, and establishing the threshold voltage |Vtp2| near the intrinsic threshold voltage for the device. The n-well 38 of the fourth transistor 32 is coupled to the supply potential, or another potential higher than the source potential for the transistor 32. Thus, the body effect increases the threshold |Vtp4| of the fourth transistor 32. Therefore, the threshold potential |Vtp4| of the fourth transistor 32 is greater than the threshold potential |Vtp2| of the second transistor 19.

Because the threshold voltage Vtp2 of the second transistor 19 is less than the threshold potential |Vtp4| of the fourth transistor 32, the voltage at node 20 is less than the voltage at node 37 in the circuit. This results in the source voltage of the first transistor 18 being less than the source voltage of the third transistor 31. Therefore the threshold voltage |Vtn3| of the third transistor 31 is greater than the threshold voltage Vtn1 of the first transistor 18.

Because the threshold voltages of the third and fourth transistors are larger than the threshold voltages of the first and second transistors as described above, the current flow in the second branch 30 of the low voltage supply circuit is off during steady state as explained below with reference to equation (1) to (5).

As mentioned above, the low voltage potential AVX generated at the node 37 is equal to the sum of the reference potential VREF plus the threshold voltage on the fourth transistor 32, as set out in equation (1)

$$AVX=VREF+|Vtp4| \tag{1}$$

(steady state).

The third transistor 31 turns on when the voltage on its gate VREF1 is greater than its threshold plus the output voltage AVX as set out in equation (2):

$$VREF1>|Vtn3|+AVX \tag{2}$$

(condition for transistor 31 to be on).

The potential VREF1 is equal to the sum of the reference potential at node 15 plus the absolute value of the thresholds across the first and second transistors 18, 19, as set out in equation (3):

$$VREF1=VREF+|Vtp2|+|Vtn1|. \tag{3}$$

To prove that transistor 31 does not turn on at steady state, the value for the output voltage from equation (1) is inserted in equation (2), and the value VREF1 of equation (2) is replaced by its equivalent from equation (3), resulting in inequality of equation (4):

$$|Vtp2|+|Vtn1|>|Vtn3|+|Vtp4| \tag{4}$$

(steady state condition for transistor 31 to be on).

As mentioned above, the threshold voltage |Vtn3| is greater than the threshold voltage |Vtn1|. Also the threshold voltage |Vtp4| is greater than the threshold voltage |Vtp2|. Thus the inequality of equation (4) cannot be satisfied during steady state. This ensures that transistor 31 will remain off as long as the output voltage on node 37 is equal to its steady state value as defined in equation (1).

During steady state, transistor 32 is likewise off. The condition for turning on transistor 32 is set out in equation (5):

$$AVX>VREF+|Vtp4. \tag{5}$$

Inserting the value of the output voltage AVX from equation (1) for the steady state condition, it can be seen that the inequality of equation (5) cannot be satisfied during steady state. Therefore, both transistors 31 and 32 are off as long as the steady state condition of equation (1) is satisfied.

If the output voltage AVX increases, transistor 32 turns on pulling it down to the steady state condition. If the voltage on the output node 37 falls, then the transistor 31 turns on pulling it up to the steady state condition. Accordingly, the low voltage supply circuit of the present invention has a very low stand-by current yet provides substantial drive when needed.

The supply voltage nodes 12 and 33 on the first branch 10 and second branch 30 respectively are typically supplied by one or more external power supplies for the integrated circuit. The supply voltage node 12 on the first branch 10 can be coupled to the standard supply voltage which generates about 5 volts +/−10%, or lower voltages, typically referred to as VDD. Alternatively, it may be coupled to the more tightly regulated potential which is typically 12 volts +/−5%, referred to as VPP. More tightly regulated voltage at the supply node 12 results in better regulation of the level of AVX during operation. Thus, it may be preferable to provide a more tightly regulated voltage at node 12 than is available from the standard 5 volt VDD supply. On the other hand, the supply node 33 on the second branch 30 may be less regulated, and is preferably coupled directly to the external supply voltage so that substantial drive current is available.

Figure 2:
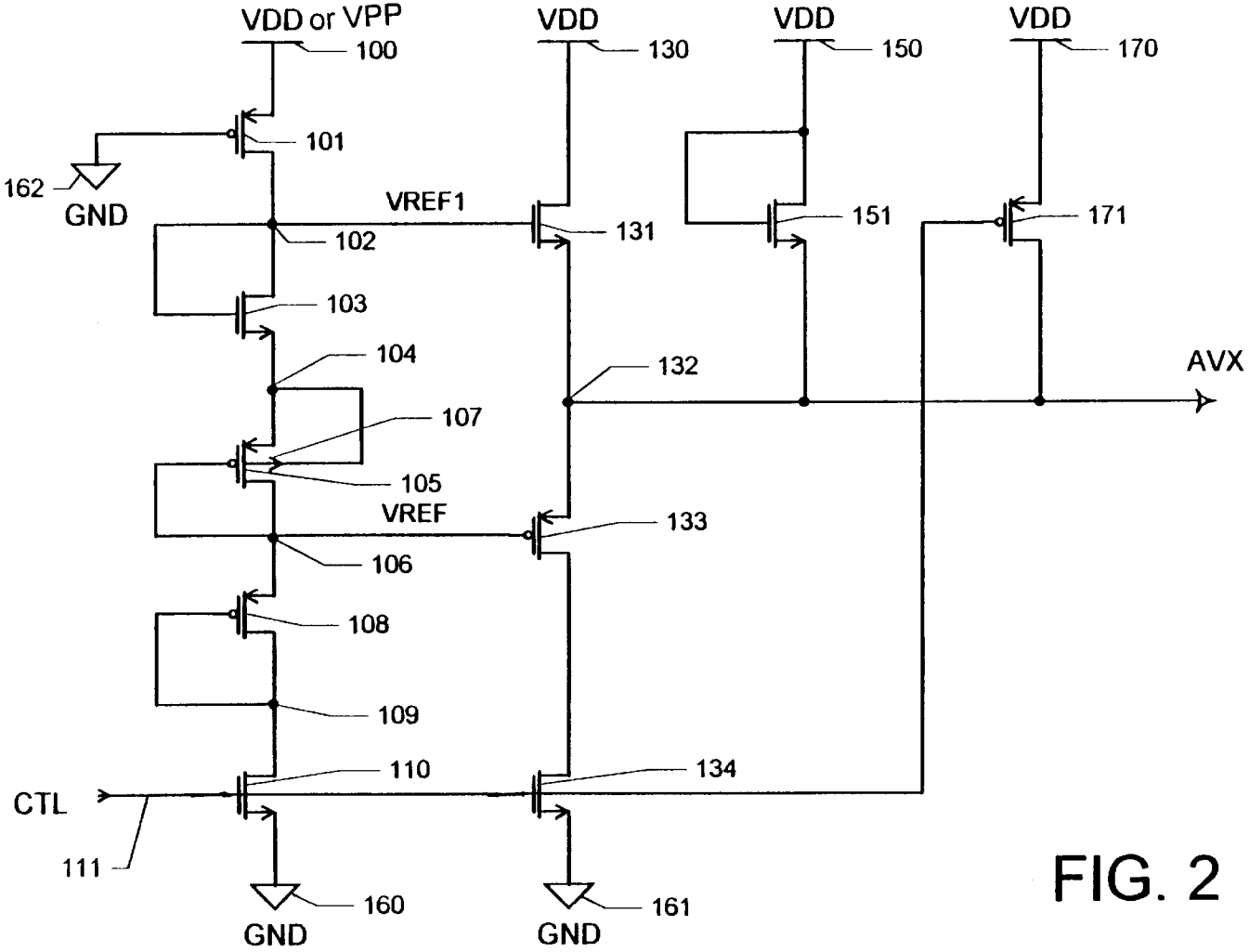
FIG. 2 is a more detailed circuit diagram of a preferred embodiment of the low voltage supply circuit of the present invention.

FIG. 2 provides a more detailed circuit diagram of a preferred embodiment of the present invention. The embodiment of FIG. 2 is implemented on a single integrated circuit which has an external voltage supply VDD coupled to the power supply nodes 100, 130, 150, and 170 in the figure. Ground supply nodes 160 and 161 are coupled to the external ground potential. Similarly, the ground supply node 162 is coupled to the external ground supply. The external supply voltage VDD is about 5 volts +/−10% in a preferred embodiment. Alternative systems may utilize lower VDD voltages as desired.

The first branch of the low voltage supply circuit in FIG. 2 includes p-channel transistor 101 having its source coupled to the supply node 100, its gate coupled to the ground supply node 162, and its drain connected to the first node 102 at which the potential VREF1 is generated. The p-channel transistor 101 acts as a resistive element, and has a width of about 4 microns and a length of about 30 microns in the example of FIG. 2.

A n-channel transistor 103 has its drain and gate connected to node 102, and its source connected to node 104. The n-channel transistor 103 corresponds to the first transistor 18 of FIG. 1. Transistor 103 in this example has a width of about 20 microns and a length of about 1 micron.

A p-channel transistor 105 has its source connected to node 104, its gate connected to node 106, and its drain connected to node 106. The p-channel transistor 105 is formed in a n-well 107 which is coupled to the node 104. Transistor 105 corresponds to the second transistor 19 in FIG. 1. In this example it has a width of about 20 microns and a length of about 1 micron.

P-channel transistor 108 has its source connected to node 106, and its gate and drain connected in common to node 109. Transistor 108 acts as the reference circuit 14 of FIG. 1, establishing a voltage potential VREF at node 106 which is equal to its threshold voltage. In this example, transistor 108 has a width of about 20 microns and a length of about 1 micron.

N-channel transistor 110 is connected between node 109 and the ground node 160. Transistor 110 has its gate connected to a control signal CTL on line 111. Transistor 110 acts as a switch for enabling and disabling the circuit in response to the control signal CTL online 111. In this example, transistor 110 has a width of about 20 microns and a length of about 0.8 microns.

The p-channel transistors 101 and 108 are formed in n-wells which are coupled to the supply potential VDD (not shown).

The second branch of the circuit is coupled to the supply node 130. The second branch includes n-channel transistor 131 having its drain connected to the supply potential 130, its gate connected to node 102, and its source connected to output node 132. Transistor 131 corresponds to the third transistor 31 in FIG. 1. N-channel transistor 131 in this example has a width of about 200 microns, and a length of about 1 micron. P-channel transistor 133 has its source connected to node 132, its gate connected to node 106, and its drain coupled through switch transistor 134 to the ground potential 161. Transistor 133 corresponds to the fourth transistor 32 in FIG. 1. In this example, transistor 133 has a width of about 300 microns, and a length of about 1 micron.

The switch transistor 134 is a n-channel transistor having its drain connected to the drain of transistor 133, its gate connected to receive the control signal CTL on line 111, and its source coupled to the ground node 161. In this example, the switch transistor 134 has a width of about 100 microns, and a length of about 0.8 microns.

As mentioned above, the p-channel transistor 133 is formed in a n-type well, which is coupled to the supply potential VDD (not shown in the figure).

Also included in the embodiment of FIG. 2 is transistor 151 connected between the supply potential 150 and the output node 132. Transistor 151 has its gate and drain coupled to the supply node 150, and its source connected to the output node 132. Transistor 151 acts as a weak leaking transistor which prevents the output node 132 from floating in the event that the first branch of the circuit generating the reference potentials VREF1 and VREF does not operate properly. Device 151 may or may not be necessary depending on a particular implementation of the circuit. In this example, transistor 151 is a n-channel device having a width of about 3 microns, and a length of about 10 microns.

Finally, a control switch transistor 171 is coupled between the supply node 170 and the output node 132. Switch transistor 171 is a p-channel transistor having its source connected to the supply potential 170, its drain connected to the output node 132, and its gate connected to the control signal CTL on line 111. In this example, the transistor 171 is a p-channel transistor having a width of about 200 microns and a length of about 0.8 microns.

Thus, it can be seen that the circuit is enabled and disabled in response to the control signal CTL on line 111. When the control signal CTL is high, transistors 110 and 134 are on, and transistor 171 is off This enables the circuit to generate the low voltage at node 132. When the control signal CTL is low, transistors 110 and 134 are off, and transistor 171 is on. This results in pulling up the node 132 to the supply potential, and turning off the low voltage supply circuit.

The circuit of FIG. 2 generates an output voltage which ranges from about 2.7 volts to about 3.2 volts. The output voltage is achieved and stabilized for a 20,000 picoFarad loading in less than 30 microseconds.

In steady state, the current through first branch including transistors 101, 103, 105, 108 and 110 is 12 microamps or less. The current through the second branch including transistors 131, 133, and 134 is about 2 microamps or less. Current through the weak pull-up transistor 151 is about 5 microamps or less. More typically, the current through the combination of the branches is less than 10 microamps in a steady state. However, the drive current capable at node 132 from the supply potential 130 reaches the milliamp range very quickly when needed. For example, the circuit of FIG. 2 is capable of sourcing and sinking more than 5 milliamps of current.

It will be appreciated that the circuits described in FIGS. 1 and 2 are used for generating a positive output voltage between the supply potential VDD and ground. Similar circuits can be utilized for generating a negative output voltage between a higher negative supply voltage and ground. To do so, the transistor types are changed from n- to p-channel, and from p- to n-channel as appropriate.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. A low voltage supply circuit supplying an internal supply voltage in an integrated circuit having first and second power supply nodes and a ground supply node, comprising:

a first transistor having a drain, a source and a gate, the drain and the gate of the first transistor connected to a first node;

a pull up circuit coupled between the first node and the first power supply node;

a second transistor having a drain, a source and a gate, the drain and the gate of the second transistor connected to a second node;

a reference circuit connected between the ground supply node and the second node, supplying a reference potential to the second node;

the sources of the first and second transistors connected to a third node;

a third transistor having a drain, a source and a gate, the drain of the third transistor coupled to the second power supply node, the gate of the third transistor connected to the first node, the source of the third transistor connected to an output node;

a fourth transistor having a drain, a source and a gate, the drain of the fourth transistor coupled to the ground supply node, the gate of the fourth transistor connected to the second node, the source of the fourth transistor connected to the output node; and bias circuits inducing a larger body effect in the fourth transistor than in the second transistor so that the fourth transistor has a threshold voltage higher in absolute value than the second transistor, and inducing a larger body effect in the third transistor than in the first transistor, so that the third transistor has a threshold voltage higher in absolute value than the first transistor, and so that the internal supply voltage is provided at the output node.

2. The low voltage supply circuit of claim 1, wherein the pull up circuit comprises a resistive element connected between the first power supply node and the first node.

3. The low voltage supply circuit of claim 1, wherein the reference circuit includes a low resistance connection between the second node and the ground supply node.

4. The low voltage supply circuit of claim 1, including:

a first switch and a second switch, the first switch connected between a ground supply node and the second node, and the second switch connected between the source of the fourth transistor and the ground supply node, the first and second switches enabling the low voltage supply circuit when closed and disabling the low voltage supply circuit when open.

5. The low voltage supply circuit of claim 4, including:

a third switch connected between the output node and the second power supply node, the third switch connecting the output node to the second power supply node when closed and enabling the low voltage supply circuit when open.

6. The low voltage supply circuit of claim 4, including:

a third switch connected between the drain of the third transistor and the second power supply node, the third switch disabling the low voltage supply circuit when open and enabling the low voltage supply circuit when closed.

7. The low voltage supply circuit of claim 1, wherein the first and second power supply nodes are coupled in common to a single power supply potential.

8. The low voltage supply circuit of claim 7, wherein the single power supply potential is regulated to be about 5 volts or less.

9. The low voltage supply circuit of claim 1, wherein the first power supply node is coupled to a first power supply potential, and the second power supply node is coupled to a second power supply potential, the second power supply potential being less tightly regulated than the first power supply potential.

10. The low voltage supply circuit of claim 9, wherein the first power supply potential is regulated to be about 5 volts or less, and the second power supply potential is regulated to be about 12 volts.

11. A low voltage supply circuit supplying an internal supply voltage in an integrated circuit having first and second power supply nodes and a ground supply node, comprising:

a first transistor having a drain, a source and a gate, the drain and the gate of the first transistor connected to a first node, the first transistor comprising a n-channel field effect transistor;

a pull up circuit coupled between the first node and the first power supply node;

a second transistor having a drain, a source and a gate, the drain and the gate of the second transistor connected to a second node, the second transistor comprising a p-channel field effect transistor in a n-type well;

a reference circuit connected between the ground supply node and the second node, supplying a reference potential to the second node;

the sources of the first and second transistors, and the n-type well of the second transistor connected to a third node;

a third transistor having a drain, a source and a gate, the drain of the third transistor coupled to the second power supply node, the gate of the third transistor connected to the first node, the source of the third transistor connected to an output node, the third transistor comprising a n-channel field effect transistor; and a fourth transistor having a drain, a source and a gate, the drain of the fourth transistor coupled to the ground supply node, the gate of the fourth transistor connected to the second node, the source of the fourth transistor connected to the output node, the fourth transistor comprising a p-channel field effect transistor in a n-type well coupled to a voltage potential higher than the output node inducing a body effect so that the fourth transistor has a threshold voltage higher in absolute value than the second transistor, and the output node having a potential higher than the third node inducing a larger body effect in the third transistor than in the first transistor, so that the third transistor has a threshold voltage higher in absolute value than the first transistor, and so that the internal supply voltage is provided at the output node.

12. The low voltage supply circuit of claim 11, wherein the pull up circuit comprises a resistive element connected between the first power supply node and the first node.

13. The low voltage supply circuit of claim 11, wherein the pull up circuit comprises a p-channel field effect transistor having a drain, a source and a gate, the drain connected to the first node, the gate connected to a reference potential, and the source connected to the first power supply node.

14. The low voltage supply circuit of claim 11, wherein the reference circuit includes a p-channel field effect transistor having a drain, a source and a gate, the drain and the gate connected in common to a ground supply node, and the source connected to the second node generating the reference potential at the second node.

15. The low voltage supply circuit of claim 11, wherein the reference circuit includes a low resistance connection between the second node and the ground supply node.

16. The low voltage supply circuit of claim 11, including:

a first switch and a second switch, the first switch connected between a ground supply node and the second node, and the second switch connected between the source of the fourth transistor and the ground supply node, the first and second switches enabling the low voltage supply circuit when closed and disabling the low voltage supply circuit when open.

17. The low voltage supply circuit of claim 16, including:

a third switch connected between the output node and the second power supply node, the third switch connecting the output node to the second power supply node when closed and enabling the low voltage supply circuit when open.

18. The low voltage supply circuit of claim 16, including:

a third switch connected between the drain of the third transistor and the second power supply node, the third switch disabling the low voltage supply circuit when open and enabling the low voltage supply circuit when closed.

19. The low voltage supply circuit of claim 11, wherein the first and second power supply nodes are coupled in common to a single power supply potential.

20. The low voltage supply circuit of claim 19, wherein the single power supply potential is regulated to be about 5 volts or less.

21. The low voltage supply circuit of claim 11, wherein the first power supply node is coupled a first power supply potential, and the second power supply node is coupled to a second power supply potential, the second power supply potential being less tightly regulated than the first power supply potential.

22. The low voltage supply circuit of claim 21, wherein the first power supply potential is regulated to be about 5 volts or less, and the second power supply potential is regulated to be about 12 volts.

23. A low voltage supply circuit supplying an internal supply voltage in an integrated circuit having first and second power supply nodes and a ground supply node, comprising:

a first transistor having a drain, a source and a gate, the drain and the gate of the first transistor connected to a first node, the first transistor comprising a n-channel field effect transistor;

a pull up transistor coupled between the first node and the first power supply node;

a second transistor having a drain, a source and a gate, the drain and the gate of the second transistor connected to a second node, the second transistor comprising a p-channel field effect transistor in a n-type well connected to the source of the second transistor;

a reference circuit connected between the ground supply node and the second node, supplying a reference potential to the second node;

the sources of the first and second transistors, and the n-type well of the second transistor connected to a third node;

a third transistor having a drain, a source and a gate, the drain of the third transistor coupled to the second power supply node, the gate of the third transistor connected to the first node, the source of the third transistor connected to an output node, the third transistor comprising a n-channel field effect transistor; and a fourth transistor having a drain, a source and a gate, the drain of the fourth transistor coupled to the ground supply node, the gate of the fourth transistor connected to the second node, the source of the fourth transistor connected to the output node, the fourth transistor comprising a p-channel field effect transistor in a n-type well coupled to a voltage potential higher than the output node inducing a body effect so that the fourth transistor has a threshold voltage higher in absolute value than the second transistor, and the output node having a potential higher than the third node inducing a larger body effect in the third transistor than in the first transistor, so that the third transistor has a threshold voltage higher in absolute value than the first transistor, and so that the internal supply voltage is provided at the output node having a potential equal to about a sum of the threshold voltage of the third transistor and the reference potential generated by the reference circuit.

24. The low voltage supply circuit of claim 23, wherein the pull up transistor comprises a p-channel field effect transistor having a drain, a source and a gate, the drain connected to the first node, the gate connected to a reference potential, and the source connected to the first power supply node.

25. The low voltage supply circuit of claim 23, wherein the reference circuit includes a p-channel field effect transistor having a drain, a source and a gate, the drain and the gate connected in common to a ground supply node, and the source connected to the second node generating the reference potential at the second node.

26. The low voltage supply circuit of claim 23, wherein the reference circuit includes a low resistance connection between the second node and the ground supply node.

27. The low voltage supply circuit of claim 23, including:

a first switch transistor and a second switch transistor, the first switch transistor connected between a ground supply node and the second node, and the second switch transistor connected between the source of the fourth transistor and the ground supply node, the first and second switch transistors enabling the low voltage supply circuit when on and disabling the low voltage supply circuit when off.

28. The low voltage supply circuit of claim 27, including:

a third switch transistor connected between the output node and the second power supply node, the third switch transistor connecting the output node to the second power supply node when on and enabling the low voltage supply circuit when off.

29. The low voltage supply circuit of claim 27, including:

a third switch transistor connected between the drain of the third transistor and the second power supply node, the third switch transistor disabling the low voltage supply circuit when off and enabling the low voltage supply circuit when on.

* * * * *